United States Patent [19]

Rozmus

[11] 4,348,212

[45] Sep. 7, 1982

[54] METHOD AND APPARATUS FOR CYCLIC DEGASSING PARTICULATE MATERIAL

[75] Inventor: Walter J. Rozmus, Traverse City, Mich.

[73] Assignee: Kelsey-Hayes Company, Romulus, Mich.

[21] Appl. No.: 267,729

[22] Filed: May 28, 1981

[51] Int. Cl.[3] ..... B03C 9/00

[52] U.S. Cl. ..... 55/2; 55/3; 55/100; 55/136; 55/150; 55/338; 55/356; 55/385 R; 134/1; 134/21; 209/127 R

[58] Field of Search ..... 55/2, 3, 6, 100, 101, 55/123, 136, 150, 154, 338, 356, 357, 385 R, 422; 134/1, 21, 25.1, 25.4; 209/1, 3, 9, 127 R, 127 C, 143; 34/92, 102

[56] References Cited

U.S. PATENT DOCUMENTS 1,801,045 4/1931 Hawley ..... 55/356

4,056,368 11/1977 Rozmus ..... 55/2

*Primary Examiner*—David L. Lacey

*Attorney, Agent, or Firm*—McGlynn and Milton

[57] ABSTRACT

An apparatus (10, 110) and method are disclosed for cleaning gas-contaminated particulate material such as powder metal. The gas-contaminated powdered metal is passed through a vacuum chamber (12, 112) having a gas outlet (14, 114) connected to a vacuum pump (119) which evacuates the chamber (12, 112). The vacuum chamber (12, 112) has first (20, 120) and second (22, 122) ends with a flow passage at each end for directing the flow of the particulate material into and out of the chamber (12, 112). The gas-contaminated particulate material is subjected to an electric field in the vacuum chamber (12, 112) to electrically charge the gaseous contaminates and cause separation of the gaseous contaminates from the powdered metal to facilitate the removal (14, 114) of the gaseous contaminates from the vacuum chamber (12, 112). First (24, 124) and second (26, 126) containers are connected to the flow passages of the vacuum chamber (12, 112).

9 Claims, 6 Drawing Figures

METHOD AND APPARATUS FOR CYCLIC DEGASSING PARTICULATE MATERIAL

TECHNICAL FIELD

This invention relates to a method an apparatus for cleaning particulate material which is at least in part contaminated by gas.

The invention is particularly useful in the field of powder metallurgy, specifically, for preparing metal powders of the superalloy type for consolidation, i.e., densification under heat and pressure. A substantial portion of the powders are produced in an inert atmosphere as, for example, argon. However, before the powder is consolidated or densified, it is necessary to remove the inert gas from the powder.

A significant advance in the degasification of powdered metal was made by the inventor named herein, Walter J. Rozmus, his invention being described and claimed in U.S. Pat. No. 4,056,368 granted Nov. 1, 1977. In accordance with that invention, degasification is accomplished by introducing gas-contaminated particulate material into a vacuum chamber which is connected to a vacuum pump. One or more electric fields are produced within the vacuum chamber by applying a potential across one or more sets of electrodes. The electrical field charges the gas contaminates and excites them so that the gas contaminates are separated from the particulate material and are more easily removed from the vacuum chamber. Such is accomplished by placing a container filled with gas contaminated particulate material above the vacuum chamber and connecting the container to the vacuum chamber so that the particulate material may flow downwardly through the vacuum chamber and into a receiver container, the receiver container being sealed and removed from the apparatus so that the powder therein remains under a vacuum for further processing. Most often one pass of the gas-contaminated particulate powder metal through the vacuum chamber does not sufficiently degass the powdered metal. In such a case, the containers must be disconnected from the vacuum assembly, repositioned and the entire assembly sequenced to initiate a new operational mode.

STATEMENT OF INVENTION AND ADVANTAGES

The subject invention relates to a method and apparatus (10, 110) for cleaning particulate material which is at least in part contaminated by gas. The gas-contaminated particulate material is passed from a first container (24, 124) downward through a vacuum chamber (12, 112) and into a second container (26, 126) while subjecting the gas-contaminated particulate material to an electric field to electrically charge the gaseous contaminates to cause the gaseous contaminates to separate from the particlate material as they pass through the vacuum chamber (12, 112) and removing through outlets (14, 114) the gaseous contaminates from the vacuum chamber (12, 112). The invention is characterized by a support means (42, 142) supporting the containers (24, 124, 26, 126) which are connected to the vacuum chamber (12, 112) for rotating the containers (24, 124, 26, 126) and the vacuum chamber (12, 112) end-for-end to position the second container (26, 126) above the vacuum chamber (12, 112) and above the first container (24, 124) for passing gas-contaminated particulate material back through the vacuum chamber (12, 112) and into the first container (24, 124).

The major advantage of the subject invention over the prior art is that the containers may be rotated back and forth through an arc of 180° to continually pass the gas-contaminated particulate material back and forth through the vacuum chamber until the particulate material has reached the desired level of degasification. All of this, of course, may occur without disconnecting the containers from the degasification system. The subject invention very significantly reduces the time required to bring a particulate material to the desired level of degasification. Additionally and very importantly, the degasification may take place continuously on an automatic basis without the need for manual connection and disconnection of containers. Another advantage of the subject invention is that the flip-flop or end-for-end motion enhances the blending of the powder. The flip-flop motion may be controlled by a control system which may be set to automatically sequence the entire system so that the degassing and flip-flop motion occurs automatically over a selected period of time.

FIGURES OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
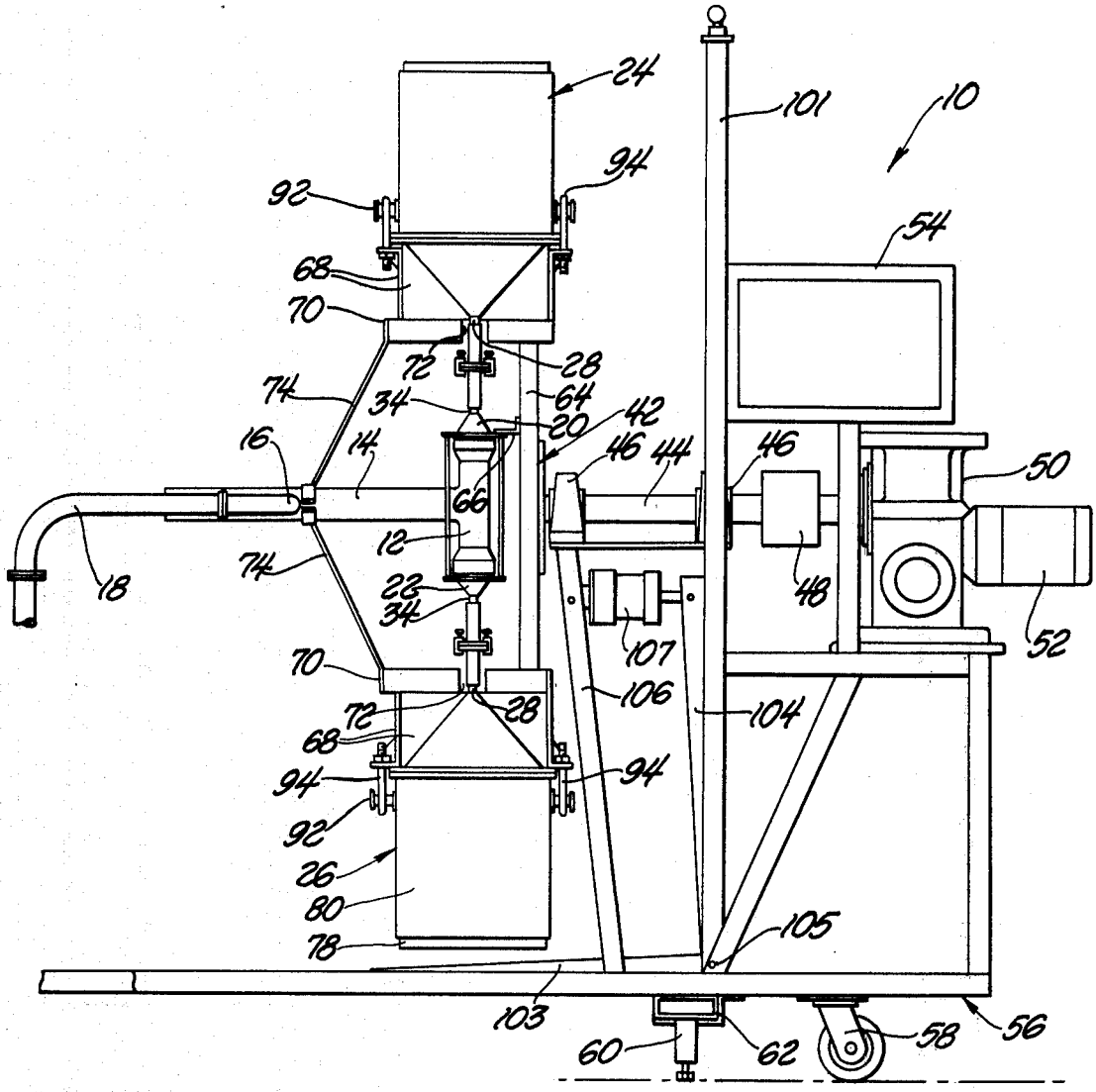
FIG. 1 is a fragmentary side-elevational view of a preferred embodiment of the subject invention.
Figure 3:
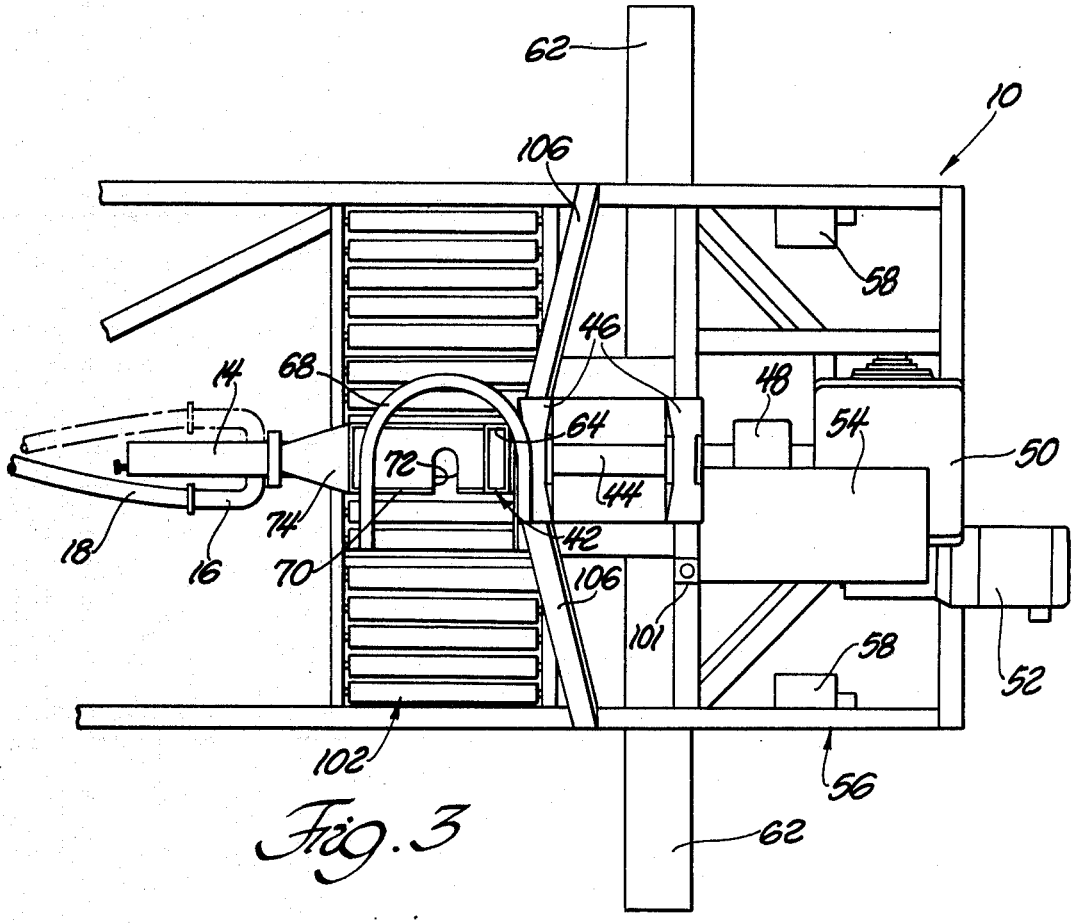
FIG. 3 is a fragmentary top view of the assembly shown in FIG. 1 but without a container.

Referring now particularly to FIGS. 1 and 3, an apparatus for cleaning particulate material such as powder metal, which is at least in part contaminated by a gas such as argon, is generally shown at 10.

The apparatus 10 includes a vacuum chamber 12 which includes a horizontally extending gas outlet 14. A rigid pipe 16 extends radially and then parallel to the outlet 14 and is connected to a flexible hose 18 which is, in turn, connected to a vacuum pump (not shown) for evacuating the chamber 12. The vacuum chamber 12 has first and second ends 20 and 22, respectively, with a flow passage at each end for directing the flow of the particulate material into and out of the chamber 12.

An electric field producing means may be vertically disposed within the chamber 12 and of the general type to be described hereinafter in connection with FIGS. 5 and 6 or may be disposed horizontally in the gas outlet tube 14 and be of the type specifically disclosed and claimed in applicant's copending application Serial No. 322,025 filed Nov. 16, 1981 and assigned to the assignee of the subject invention. As described in applicant's U.S. Pat. No. 4,056,368, the electric field producing means produces an electric field for subjecting the gas-contaminated particulate material to the electric field to electrically charge the gaseous contaminates and cause separation of the gaseous contaminates from the particulate material to facilitate removal of the gaseous contaminates from the vacuum chamber 12 through the gas outlet 14.

Figure 2:
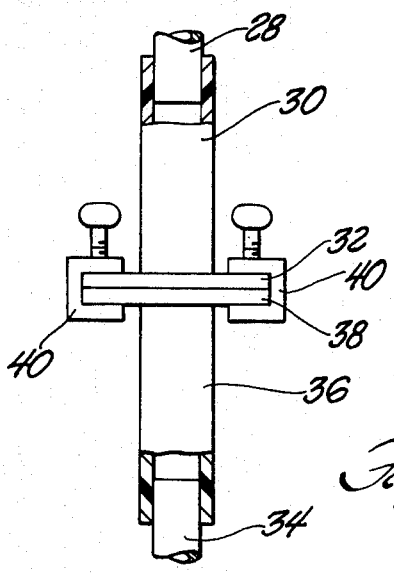
FIG. 2 is an enlarged fragmentary cross-sectional view showing the components for connecting and disconnecting a container to the vacuum chamber of the system.

The apparatus includes first and second container means generally indicated at 24 and 26. The container means 24 and 26 are identical and completely interchangeable. The respective container means 24 and 26 are connected to and in communication with the flow passages at the first and second ends 20 and 22 of the vacuum chamber 12. The connection of each container to the vacuum chamber is more specifically illustrated in FIG. 2. As shown in FIG. 2, each container has a rigid tube 28 extending therefrom. Connected to the end of the tube 28 is a flexible hose 30 having integrally formed therewith an annular flange 32. The tube 30 may be clamped, glued or otherwise secured to the tube 28 so as to perfect a hermetic seal therebetween. In a similar fashion, a rigid tube 34 extends from the respective ends 20 and 22 of the vacuum chamber 12 and a flexible tube 36 with a flange 38 at the end thereof is disposed about the tube 34 and is hermetically sealed thereto. In other words, the flexible tubular members 30 and 36 are identical. The flanges 32 and 38 are annular and have at least one annular O-ring therebetween for sealing and are clamped together by an appropriate clamping device such as the C-shaped clamping members 40 having wing nuts associated therewith for urging the flanges 32 and 38 into sealed relationship with one another. In order to remove a container from the apparatus, the flexible tubular members 30 and 36 would be clamped or squeezed together to perfect a seal along the tubular members 30 and 36 to respectively seal the passage into the container and the passage into the vacuum chamber. After the hoses or tubes 30 and 36 are sealed, the clamps 40 could be removed to separate the flanges 32 and 38. In this manner, a container may be removed from the apparatus while sealed to the surrounding atmosphere. To place a container in communication with the vacuum chamber, the reverse process is accomplished.

The apparatus 10 includes a support means generally indicated at 42 supporting the vacuum chamber 12 and the containers 24 and 26. The support means 42 initially positions the first container 24 above the second container 26 as illustrated to allow particulate material to flow from the first container 24 down through the vacuum chamber 12 and into the second container 26. After the particulate material has emptied from the container 24 and passes through the vacuum chamber 12 and into the container 26, the support means 42 may thereafter rotate the vacuum chamber 12 and the containers 24 and 26 while they remain connected together to reposition the second container 26 above the first container 24 to allow the particulate material to return from the second container 26 in the opposite direction back through the vacuum chamber 12 to the first container 24. The gas contaminated particulate material is passed from the one container downward through the vacuum chamber 12 and into the other container while being subjected to an electric field to electrically charge the gas contaminates to cause the gaseous contaminates to separate from the particulate material and be removed from the vacuum chamber 12 through the gaseous outlet 14. As alluded to above, it may not be possible to remove the gaseous contaminates from the particulate material to the desired degree in one pass of the particulate material through the vacuum chamber 12. Therefore, the support means rotates the first and second containers 24 and 26 along with the vacuum chamber 12 end-for-end to position the second container 26 in the original position of the first container 24 and above the vacuum chamber 12 and above the first container 24 which is then in the original position of the second container 26 for passing the gas-contaminated particulate material back through the vacuum chamber 12 in the opposite direction from the second container 26 into the first container 24.

The apparatus sequentially rotates the first and second containers 24 and 26 and the vacuum chamber 12 end-for-end and back and forth through an arc of 180° until the particulate material is degassed to the desired degree. In the movement back and forth through 180°, the flexible hose 18 leading to the vacuum source, such as the vacuum pump, flip flops 180° back and forth between the positions shown in full lines and in phantom, respectively, in FIG. 3. In other words, the support means 42 does not rotate 180°, stop for the particulate material to pass from one container to the other, and then continue in the same direction through another 180°. To the contrary, the support means 42 rotates through 180° to exchange the positions of the containers 24 and 26 and after one container was emptied into the other, rotates in the opposite direction through a 180° to again reposition the containers one for the other.

This is accomplished by a drive means for rotating the support means 42 back and forth through the arc of 180° about an axis of rotation which is coaxial with the gaseous outlet 14. The drive means includes a shaft 44 rotatably supported in two bearing blocks 46 and having a distal end connected to and supporting the support means 42. The drive means further includes a coupling member 48 coupling the shaft 44 to a gear box 50 which is, in turn, driven by a motor 52 to form part of the drive means. The sequencing of the entire system may be accomplished by a controller unit 54 including the appropriate controls. All of the components are supported on a frame work 56 having interconnected metal beams and channels welded together and supported for movement by wheels or casters 58 and which, when in a stationary position, may be supported on adjustment posts 60 extending downwardly from the outwardly extending beams 62.

The support means 42 includes a beam 64 which is fixedly secured to the end of the shaft 44. One or more brackets 66 extend from the beam 64 for supporting the vacuum chamber 12. At each end of the beam 64 are connecting means for removably connecting the containers 24 and 26 thereto. More specifically, the connection means includes a pair of generally U-shaped saddle members 68 supported by and extending upwardly from box-like support members 70. The box-like support members 70 have U-shaped openings 72 for allowing movement of the tubes 28 of the respective containers to move into and out of position. Braces 74 extend from the outward ends of the box-like support members 70 at an angle toward the axis of rotation for supporting the gaseous outlet 74.

Figure 4:
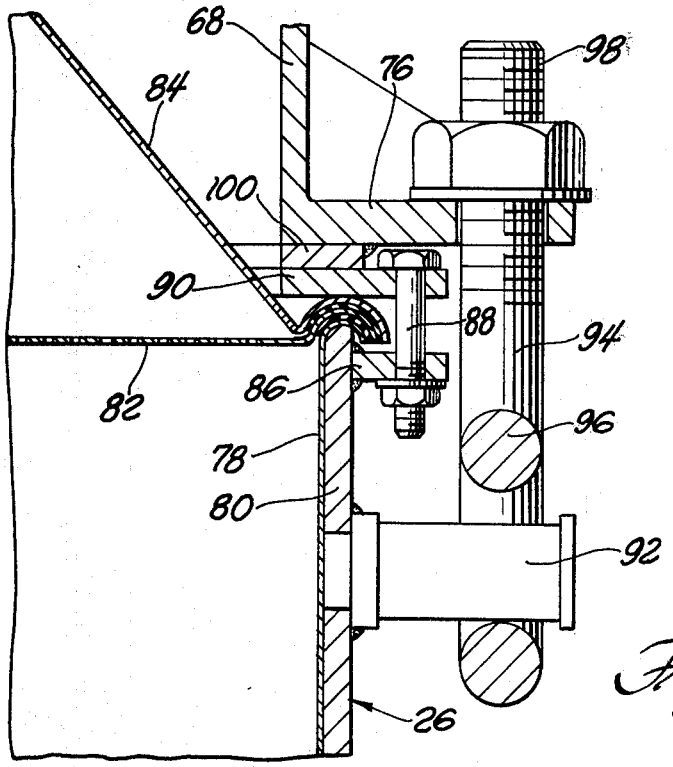
FIG. 4 is an enlarged fragmentary cross-sectional view of the connection means for removably connecting a container into the system.

The connection means for the containers includes clamping means for clamping the respective containers 24 and 26 against the respective saddle members 68. As illustrated in FIGS. 1, 3 and 4, each of the saddle members 68 has a U-shaped horizontal flange 76 extending laterally from the U-shaped wall of the saddle member 68. Each container means includes a thin liner 78, such as stainless steel, disposed within a protective or reinforcing jacket 80. The upper end of the side wall of the container 78 is rounded to pass over a rounded upper end of the jacket 80. A gasket is disposed over the rounded upper end of the container 78 with a perforated member 82 having a rounded circumference disposed over the jacket and having a gasket disposed thereover for receiving the round peripheral edge of a metal conical cover 84. The jacket 80 has a flange 86 extending therefrom for receiving a tightening bolt 88. An annular ring 90 clamps the arcuate peripheries of the members into sealing relationship as the bolt or fastener 88 is tightened. The seal is a hermetic seal so that the container may be transported under a vacuum. The perforated member 82 facilitates the blending of the powder as the powder flows into and out of the container.

A pair of pins 92 are welded to the jacket 80 and extend from diametrically opposite sides. An eyebolt 94 has a circular portion 96 for engaging a pin 92 and a threaded portion 98 extending upwardly through a hole in the flange 76 of the saddle member. An annular spacer ring 100 is welded or otherwise secured to the flange 76 for allowing a space for the head of the fastener nut 88 whereby the bolt 94 may be tightened to clamp the container against the flange 76 of the saddle member 68. Thus, the pins 92 and bolts 94 define clamping means as part of the connecting means and perform the function of clamping the containers against the saddle members.

The framework 56 includes an upwardly extending post 101 which supports a light at the top thereof for indicating when the apparatus is in operation. Adjacent the post 101 and centrally disposed of the apparatus is a loading means for moving a container into and out of position for connection and disconnection from the saddle members 68. More specifically, the apparatus includes a bed of rollers generally indicated at 102 in FIG. 3. Associated with those rollers and centrally thereof is an L-shaped frame having a lower or generally horizontally extending bed 103 and an upper or generally vertical extending frame 104 pivotal about an axis 105. The framework 56 includes the suppport beams 106 and disposed centrally between those beams 106 is a hydraulic motor 107 connected to the vertical frame 104 of the loading system. As illustrated in FIG. 1, if it is desired to remove the container 26 from the apparatus, the motor 107 would be actuated to rotate the vertical frame 104 clockwise about the axis 105 to raise the bed 103 to engage the bottom of the container 26 for supporting same. While being supported on the bed 103, the bolts 94 would be disconnected to allow the full weight of the container to rest upon the bed 103. Thereafter, the motor 107 would be actuated to move the container 26 downwardly so that it could cooperate with the rollers 102 to be moved laterally out of the apparatus.

Figure 5:
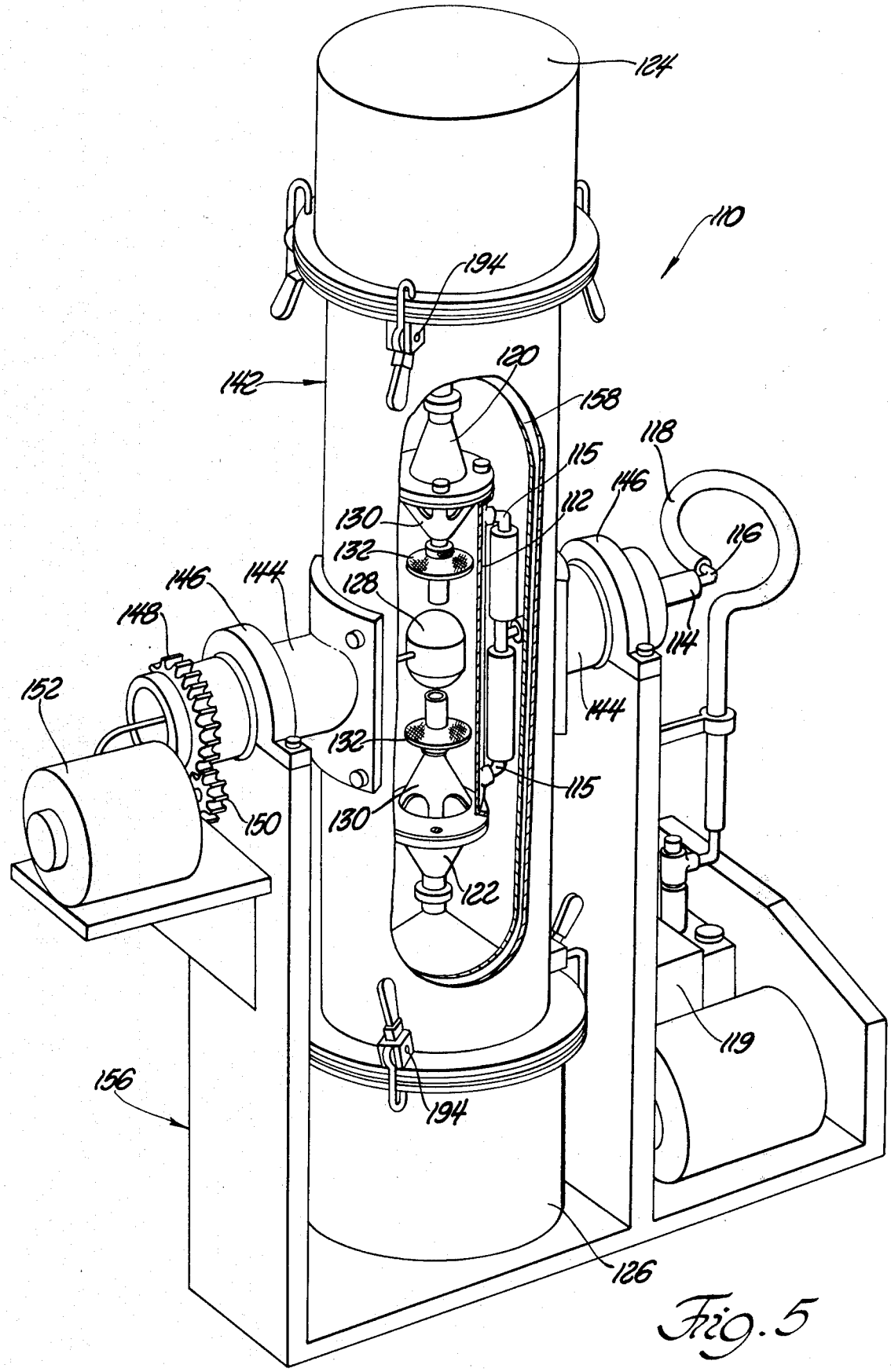
FIG. 5 is a perspective view partially cut away and in cross section of a second preferred embodiment of the subject invention.
Figure 6:
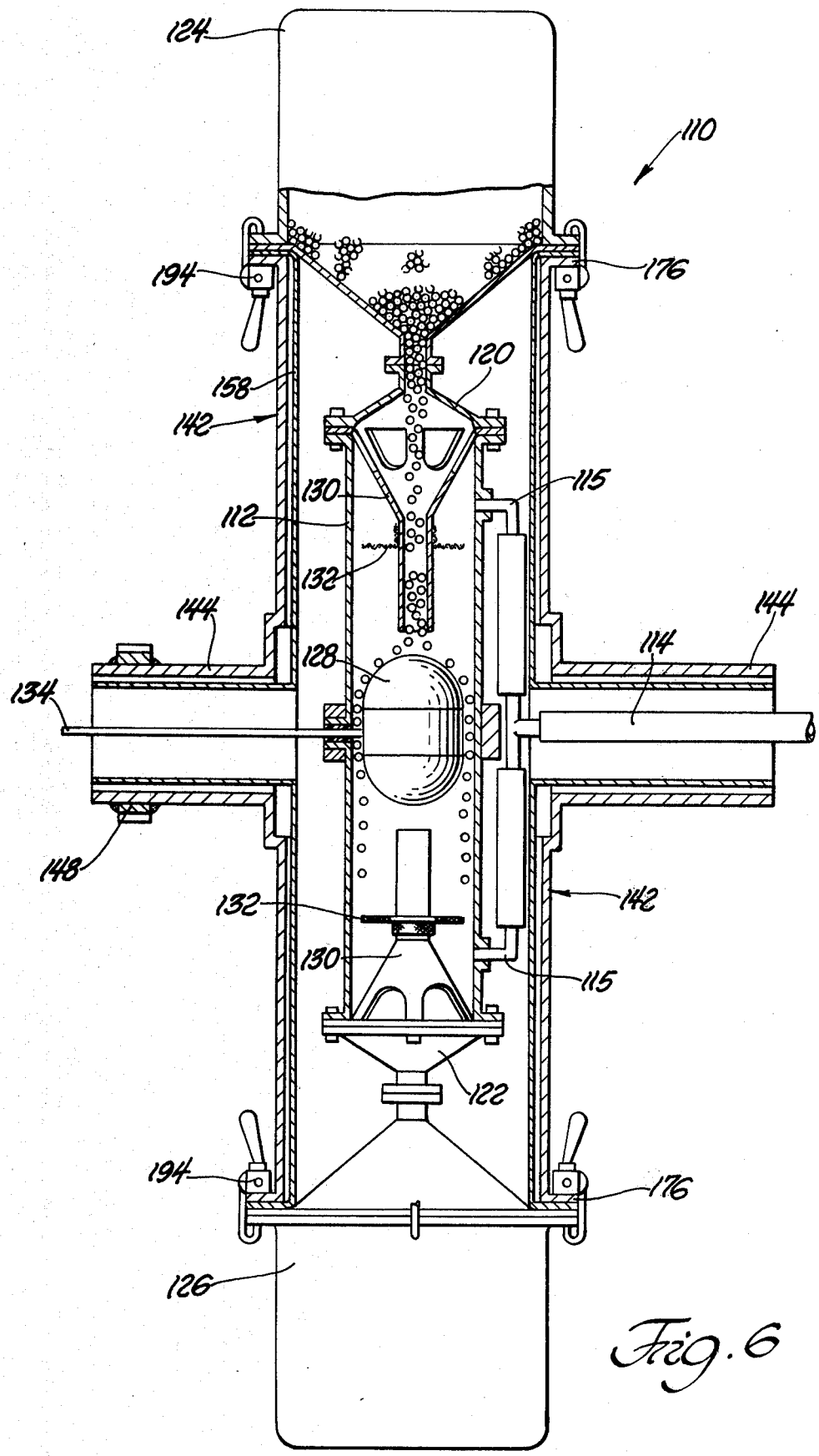
FIG. 6 is a cross-sectional view of a schematic illustration of the embodiment of FIG. 5.

An alternative embodiment of the subject invention is generally shown at 110 in FIGS. 5 and 6.

As in the first embodiment, there is included a vacuum chamber 112 having a gas outlet tube 114 connected to opposite ends of the vacuum chamber 112 by the connections 115. The gas outlet tube 114 is connected through a rigid joint 116 to a flexible tubular member 118. The tubular member 118 is flexible and flip flops back and forth between 180° in a similar fashion to the flexible tubular member 18 of the first embodiment. The tubular member 118 is connected to a vacuum pump means 119 for evacuating the chamber 112 of gaseous contaminates by placing the chamber 112 under a vacuum.

The vacuum chamber 112 has first and second ends 120 and 122, respectively, with a flow passage or tube at each end for directing the flow of the particulate material into and out of the chamber 112.

Connected to and in hermetically sealed communication with the flow passages at the first and second ends 120 and 122 of the vacuum chamber 112 are the first and second containers 124 and 126. Although not illustrated, the containers 124 and 126 may be connected to the respective ends 120 and 122 of the vacuum chamber 112 in the manner illustrated and described in connection with FIG. 2.

The electric field producing means includes a plurality of electrodes symmetrically arranged relative to the axis of rotation with at least one electrode 128 disposed on the axis of rotation. More specifically, a funnel-shaped glass member 130 is disposed at each end of the interior of the vacuum chamber and has a downwardly extending outlet through which the particulate material flows. An electrode 132 is disposed about the exterior of the lower portion of the funnel-shaped members 130, the electrodes 132 being symmetrically arranged relative to the central electrode 128 and relative to the axis of rotation. An electrical lead 134 is disposed in sealing engagement with the chamber 112 and is connected to the electrode 128. Other appropriate leads pass through and into the chamber 112 to the electrodes 132.

The assembly 110 includes a support means generally indicated at 142 for supporting the vacuum chamber 112 and the containers 124 and 126. The support means 142 has trunnions or shafts 144 extending from opposite sides thereof and rotatably supported in bearing mounts or blocks 146. A ring gear 148 is welded or otherwise fixed to one of the trunnions 144 and meshes with a pinion 150 which is, in turn, driven by a motor 152. All of the components are supported upon a support frame or structure generally indicated at 156.

The support means 142 includes a liner 158 and has container support flanges 176. The flanges 176 support the clamping assemblies 194 which define clamping means for clamping the respective containers 124 and 126 against the respective support flanges 176.

There is included appropriate sequencing means for actuating the motor 152 whereby the support means 142 initially positions the first container 124 above the second container 126 as illustrated to allow particulate material to flow from the first container 124 through the vacuum chamber 112 and into the second container 126 as illustrated in FIG. 6. Thereafter, the support means 142 may be rotated to rotate the vacuum chamber 112 and the containers 124 and 126 while connected together to reposition the second container 126 above the first container 124 to allow the particulate material to return from the second container 126 in the opposite direction back through the vacuum chamber 112 to the first container 124. The containers are moved back and forth through an arc of 180° as in the case of the first embodiment.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

I claim:

1. An apparatus (10, 110) for cleaning particulate material which is at least in part contaminated by gas, said apparatus comprising; a vacuum chamber (12, 112) having a gas outlet (14, 114), vacuum pump means (119) connected to said gas outlet for evacuating said chamber, said vacuum chamber (12, 112) having first (20, 120) and second (22, 122) ends with a flow passage at each end for directing the flow of the particulate material into and out of said chamber electric field producing means (128, 132) positioned and arranged so as to produce an electric field to electrically charge the gaseous contaminates and cause separation of the gaseous contaminates from the particulate material to facilitate removal of the gaseous contaminates from said vacuum chamber (12, 112) through said gas outlet (14, 114), first (24, 124) and second (26, 126) container means connected to and in communication with said flow passages at said first and second ends of said vacuum chamber, support means (42, 142) supporting said vacuum chamber and said first and second container means for initially positioning said first container means (24, 124) above said second container means (26, 126) to allow particulate material to flow from said first container means (24, 124) through said vacuum chamber (12, 112) and into said second container means (26, 126) and for thereafter rotating said vacuum chamber (12, 112) and said first and second container means (24, 124, 26, 126) while connected together to reposition said second container means (26, 126) above said first container means (24, 124) to allow particulate material to return from said second container means (26, 126) in the opposite direction back through said vacuum chamber (12, 112) to said first container means (24, 124).

2. An apparatus (10, 110) as set forth in claim 1 further including connection means (68, 92, 94, 194) for removably connecting said container means (24, 124, 26, 126) to said support means.

3. An apparatus (10) as set forth in claim 2 wherein said connection means includes a pair of generally U-shaped saddle members (68) with each saddle member (68, 76, 100) engaging one of said container means (24, 26).

4. An apparatus (10) as set forth in claim 3 wherein said connection means includes clamping means (92, 94) for clamping the respective container means (24, 26) against said respective saddle members (68, 76, 100).

5. An apparatus (10, 110) as set forth in claim 1 further including drive means (44, 48, 50, 52, 144, 148, 150, 152) for rotating said support means (42, 142) back and forth through an arc of 180° about an axis to reverse the positions of said first and second container means (24, 26, 124, 126) while rotating said vacuum chamber (12, 112) end-for-end.

6. An apparatus (10, 110) as set forth in claim 5 wherein said electric field producing means includes a plurality of electrodes (128, 132) symmetrically arranged relative to said axis with at least one electrode (128) disposed on said axis.

7. An apparatus (10) as set forth in claim 1 further including loading means (103, 104) for moving said first and second container means into and out of position for connection to and disconnection from said support means (42) by said connection means.

8. A method of cleaning particulate material which is at least in part contaminated by gas, including passing said gas-contaminated particulate material from a first container (24, 124) downward through a vacuum chamber (12, 112) and into a second container (26, 126), subjecting the gas-contaminated particulate material to an electric field to electrically charge the gaseous contaminants to cause the gaseous contaminants to separate from the particulate material, applying a vacuum to the vacuum chamber for removing (14, 114) the gaseous contaminants from the vacuum chamber (12, 112), rotating the first (24, 124) and second (26, 126) containers and the vacuum chamber (12, 112) end-for-end to position the second container (26, 126) above the vacuum chamber (12, 112) and above the first container (24, 124) for passing said gas-contaminated particulate material back through the vacuum chamber (12, 112) and into the first container (24, 124).

9. A method as set forth in claim 8 further including sequentially rotating the first (24, 124) and second (26, 126) containers and the vacuum chamber end-for-end, back and forth, through an arc of 180° until the particulate material is degassed to a predetermined degree.

* * * * *